US005976344A

United States Patent [19]

Abys et al.

[11] Patent Number: 5,976,344

[45] Date of Patent: Nov. 2, 1999

[54] COMPOSITION FOR ELECTROPLATING PALLADIUM ALLOYS AND ELECTROPLATING PROCESS USING THAT COMPOSITION

[75] Inventors: Joseph Anthony Abys, Warren, N.J.; Irina Boguslavsky, Naperville, Ill.; Heinrich K. Straschil, Summit, N.J.

[73] Assignee: Lucent Technologies Inc., Murray Hill, N.J.

[21] Appl. No.: 08/974,120

[22] Filed: Nov. 19, 1997

Related U.S. Application Data

[63] Continuation of application No. 08/644,347, May 10, 1996, abandoned.

[51] Int. Cl.[6] ..... C25D 3/50

[52] U.S. Cl. ..... 205/257; 205/265; 106/1.27; 106/1.28

[58] Field of Search ..... 205/257, 259, 205/265; 106/1.28, 1.27

[56] References Cited

U.S. PATENT DOCUMENTS

| | | | |
|---|---|---|---|
| 3,580,820 | 5/1971 | Yamamura et al. | 205/257 |
| 3,933,602 | 1/1976 | Henzi et al. | 205/257 |
| 4,048,023 | 9/1977 | Stevens | 205/257 |
| 4,144,141 | 3/1979 | Schuster et al. | 204/47 |
| 4,242,180 | 12/1980 | Heppner et al. | 204/47 |
| 4,428,802 | 1/1984 | Kanai et al. | 205/257 |
| 5,552,031 | 9/1996 | Moon | 205/257 |

FOREIGN PATENT DOCUMENTS

| | | |
|---|---|---|
| 2741347 | 9/1977 | Germany . |
| 2089374A | 6/1982 | United Kingdom . |

OTHER PUBLICATIONS

DatabAse WPI, "Electrolyte for producing palladium nickel alloy coatings—contains palladium chloride, Nickel sulphate, ammonium, sodium or potassium and ethanolamine, sodium edetate, alanine or glycine", Section Ch, Week 9115, Derwent Publications Ltd., London, GB; Class E37, AN 91–108569, XP002095117 Aug. 1990.

P.M. Vyacheslavov, et al., Electrodeposition of Palladium–Cobalt Alloy translated from Zaschita Mettalov, vol. 5, No. 5, pp. 348–349, May–Jun., 1969.

S.N. Vinogradov, et al., Electrolytic Deposition of a Palladium–Cobalt Alloy translated from Zaschita Mettalov, vol. 4, No. 5. pp. 543–547, Sep.–Oct., 1968.

S.N. Vinogradov, et al., Internal Stresses in Electrolytic Palladium–Cobalt Alloy translated from Zaschita Metallov vol. 5, No. 6, pp. 686–687, Nov.–Dec., 1969.

S.N. Vinogradov, et al, The Electrodeposition of Palladium–Cobalt Alloy from a Complex Electrolyte with Mixed Ligands, translated from Zaschita Metallov, vol. 7, No. 5, pp. 612–613 Sep.–Oct., 1971.

A.I. Zayats, et al., Study of Electrodeposition and Certain Physical Properties of Disperse Palladium–Cobalt Alloys, Translated from Zhurnal Priknadnoi Khimii vol. 45, No. 9, pp. 1948–1953, Sep., 1972.

S.N. Vinogradov, et al., Deposition of Palladium–Cobalt Alloy From an Ammonia Electrolyte, Translated from Zashchita Metallov, vol. 14, No. 3, pp. 362–365, May–Jun., 1978.

E.V. Chumak, et al., Use of Chronopotentiometric Results in Palladium–Cobalt Alloy Electrodeposition Technology, Translated from Elektrokhimiya, vol. 25, No. 12, pp. 1668–1670, Dec., 1989.

*Primary Examiner*—Kishor Mayekar
*Attorney, Agent, or Firm*—Gibbons, Del Deo, Dolan, Griffinger & Vecchione

[57] ABSTRACT

An aqueous electroplating bath for the electrodeposition of palladium alloys in a mixed ligand system. A first ligand operates to form a complex of palladium and a second ligand functions to form a complex of another metal which brings the plating potentials of the two metals closer together. Palladium and the alloying metal thus exist as complexes with different structures.

8 Claims, No Drawings

COMPOSITION FOR ELECTROPLATING PALLADIUM ALLOYS AND ELECTROPLATING PROCESS USING THAT COMPOSITION

REFERENCE TO RELATED APPLICATION

This application is a continuation-in-part of U.S. patent application Ser. No. 08/644,347, filed May 10, 1996 now abandoned entitled "Composition for Electroplating Palladium Alloys And Electroplating Process Using that Composition," by the same inventors herein.

BACKGROUND OF THE INVENTION

1. Field of the Invention

This invention relates to baths for the electroplating of palladium alloys, and in particular to the deposition of iron and cobalt alloys of palladium in a mixed ligand system and a process therefore.

2. Description of Related Art

Electroplating is a well known process for providing a coating upon a substrate to enhance its appearance; to improve its resistance to corrosion, abrasion, or diffusion; or to improve and maintain its solderability. In the electronics industry, precious metals have been used as contact materials to ensure low resistance, noise free contacts which are reliable over time even under severe environmental conditions which would degrade metals such as copper. Due to their cost, precious metals are used only where their desirable properties of corrosion resistance or bondability are needed, and electroplating has proven to be an efficient process to provide a controlled amount of a deposit onto a specified area.

There are always pressures to reduce cost, so palladium is often substituted for gold plating. For connectors and contacts, a controlled degree of hardness and wear resistance is also needed to ensure reliable operation over many cycles. The base metal is typically copper or beryllium copper alloy, which is first plated with 30 to 100 microinches of nickel to limit pinholes and corrosion. Palladium has been plated over nickel to provide a low contact resistance, but palladium alone is relatively soft in applications where many cycles of connector operation are anticipated. A palladium-nickel alloy increases the hardness of the deposit and improves wearability. However, quality control measures often use x-ray fluorescence to determine the thickness and composition of electroplates. So where nickel is present as an underlayer and as a constituent in the electroplate, quality control is made more difficult. These measurements are important because they can determine the corrosion resistance and contact reliability of the plated part. Nickel also has allergenic properties which affect some persons, so the use of palladium-nickel alloys may be restricted in some decorative applications. Consequently, there are applications in which it is more desirable to plate palladium-iron or palladium-cobalt to increase the hardness of the deposit, improve the quality control of the deposit and reduce its allergenic effects.

For example, U.S. Pat. No. 4,242,180 given to Heppner et al. discloses a process and a series of plating baths which deposit palladium and palladium alloys. The palladium is present as a diglycinate palladium II complex, using aminoacetic acid as the sole complexing agent. The bath can also contain conducting salts, buffer reagents, and complexing agents such as ethylenediamine-tetraactetic acid or nitrilotriacetic acid for complexing non-palladium metallic impurities, surface active substances, or the like. Baths with dissolved alloying agents such as nickel, silver, and cobalt are given by way of example.

Ammonia-containing plating baths have been described in the literature by Vinogradov et al. in Zashchita Metallov, Vol. 4, No. 5, pp. 543–547, 1968, and Zashchita Metallov, Vol. 7, No. 5, pp. 612–613, 1971. In the former work, palladium-cobalt alloys were deposited in an amino-chloride electrolyte containing palladium in the form of [Pd(NH3)4] Cl2. Ammonium chloride and sodium hydroxide were added to adjust the pH to a value of 10. Cobalt was added in the form of [Co(NH3)6]Cl2. The wear resistance and internal stress of the Pd—Co alloy increased sharply with the increase of the concentration of cobalt in the bath. In the latter work, cobalt in the form of a pyrophosphate complex derived from K6Co(P2O7)02 was used to lower the internal stress in the alloy of the former work. The pyrophosphate electrolyte more efficiently wets the cathode surface and increases the current yield of the alloy. The deposits became dull and more crystalline above a current density of 1 A/dm2. The recommended bath also includes potassium pyrophosphate, ammonium chloride, and ammonium citrate. These baths were used to study the mechanical properties of the deposits for various plating conditions but they would be difficult to maintain in a production environment because they operate in a narrow range of pH and low current density.

Accordingly, there is a need in the art for a palladium alloy plating bath and process which provides bright, adherent, and ductile deposits which are hydrogen-free and are both chemically and electrochemically stable. The bath should also be versatile enough to deposit a range of alloy compositions ranging from 10% to 95% palladium and be amenable to both high speed plating which is encountered in reel-to-reel plating operations which are typical of plating electrical contacts and slow speed plating operations which are exemplified in rack or barrel plating operations for decorative articles. Additionally, it is desirable to keep the present contact/connector technology which may employ a nickel barrier over a base metal yet not interfere with x-ray fluorescence quality control measures.

SUMMARY OF THE INVENTION

The present invention relates to the electroplating of palladium alloys in a mixed ligand system. A first ligand operates to form a complex of palladium and a second ligand functions to form a complex of another alloying metal and to bring the electroplating reduction potentials of the alloying metal and the palladium closer together relative to the alloying metal electroplating reduction potential and the palladium electroplating reduction potential in the presence of the first ligand alone.

Palladium and the alloying metal thus exist as complexes with different structures. Since the electroplating reduction potentials of the two metals are closer together than they would be in the presence the first ligand alone, a consistent stable alloy composition ranging from 10% to 95% palladium is accomplished in a wide range of current densities. The bath is amenable to high or slow speed plating operations.

Ammonia or organic amines are used as ligands for the palladium complex. The second ligand may be selected from the group consisting of mono-, di-, and tetra-carboxylic acids which include acetic, malonic, glutaric, and ethylenediamine-tetraacetic (EDTA) acids. The alloying metal is used to harden the plated layer thus providing increased wear resistance for electrical contacts. The addition of any base metal from Group VIII will serve to harden palladium. The baths described herein are useful because they are both chemically and electrochemically stable enough for industrial applications and they may be operated over a wide range of cathode current densities making them suitable for continuous or rack plating operations. Alloys containing from 10 to 95 percent palladium may be deposited from these baths.

In one embodiment of the invention cobalt is the alloying metal.

In another embodiment of the invention, iron is the alloying metal.

In alternative embodiments of the invention, ruthenium, rhodium or iridium is the alloying metal.

A process is described for the deposition of these layers.

These and other features and advantages of the invention will be better understood with consideration of the following detailed description of the preferred embodiments.

DETAILED DESCRIPTION OF THE PREFERRED EMBODIMENTS

In order to provide a palladium plating bath which results in stable palladium alloy deposition over a wide range of current densities, the present invention employs a mixed ligand system comprising at least a first ligand to complex the palladium and a second ligand to complex a selected alloying base metal. The alloying base metal is used to harden the palladium deposit for increased wear resistance in connector applications and also to lower the cost in other applications such as corrosion protection or decorative applications. The second ligand is chosen to bring the plating potential of the selected alloying base metal and the plating potential of palladium closer together than they would be in the presence of the first ligand alone. By way of example, the base metal may be at least one of the following: iron (Fe), cobalt (Co), ruthenium (Ru), rhodium (Rh) and iridium (Ir).

Certain alloying metals, for example, iron and cobalt, often do not produce satisfactory deposits of palladium metal in known electroplating baths such as those which are suitable for nickel. This is based on the difference in the chemical properties of cobalt and nickel. For example, even though nickel and cobalt are neighbors in the periodic table, their properties and the structure of their complexes are different. Nickel has a stable oxidation state +2, while cobalt tends to form two oxidation states, +2 and +3 which co-exist in the plating bath. Nickel forms planar complexes with coordination number 4 while cobalt forms preferably octahedral complexes with coordination number 6. Nickel has a strong affinity for nitrogen containing ligands and cobalt binds favorably to oxygen containing ligands. These different binding affinities determine the major differences in designing electroplating chemistries for palladium/nickel and palladium/cobalt alloy deposition.

To design an improved electroplating bath, the electroplating reduction potentials of certain metals were determined by cyclic voltammetry on the stationary electrode using ammonia/ammonium sulfate mixture at pH 8.0 as a background electrolyte. The potentials of the maximum current were considered electroplating reduction potentials. Cyclic voltammetry was employed to measure the electroplating reduction potentials of palladium and nickel in an aqueous ammonia/ammonium Pd/Ni alloy electroplating system before and after the addition of one of several second ligands. Ammonia acted as the first ligand. The electroplating reduction potentials of palladium and nickel were initially determined in the present of the first ligand alone. Next, cyclic voltammetry was employed to determine the electrodeposition reduction potentials of palladium and nickel in the ammonia/ammonium Pd/Ni alloy electroplating system after the addition of one of several second ligands. Again, ammonia acted as the first ligand.

Cyclic voltammetry was employed to measure the electroplating reduction potentials of palladium and cobalt in an ammonia/ammonium Pd/Co alloy electroplating system before and after the addition of one of several different second ligands. Ammonia acted as the first ligand. The electroplating reduction potentials of palladium and cobalt were initially determined in the present of the first ligand alone. Next, cyclic voltammetry was employed to determine the electrodeposition reduction potential of palladium and cobalt in the same ammonia/ammonium Pd/Ni alloy electroplating system after the addition of one of several second ligands. Again, ammonia acted as the first ligand. The results are given in Table 1;

TABLE 1

EFFECT OF THE ADDITION OF A SECOND LIGAND ON THE DEPOSITION POTENTIAL OF METALS IN AN AMMONIA/AMMONIUM SYSTEM

| SECOND LIGAND | NONE | Acetic Acid | Malonic Acid | Glutaric Acid | Citric Acid |
|---|---|---|---|---|---|
| E(Pd)/E(Ni) | −0.98/−1.05 | −0.98/−1.05 | −0.98/−1.05 | −0.98/−1.05 | −0.98/−1.05 |
| E(Pd)/E(Co) | −0.95/−0.70 | −0.9/−0.86 | −0.9/−0.88 | −0.9/−0.86 | −0.9/−0.86 |
| SECOND LIGAND | Tartaric acid | Oxalic Acid | EDA* | GLYCINE | EDTA** |
| E(Pd)/E(Ni) | −0.98/−1.05 | −0.98/−1.05 | −0.98/−1.05 | −0.98/−1.05 | −0.98/−1.05 |
| E(Pd)/E(Co) | −0.9/−0.86 | −0.9/−0.86 | −0.9/−0.86 | −0.9/−0.86 | −0.9/−0.86 |

Deposition reduction potentials are given in volts.
E(Pd) = reduction potential for palladium
E(Ni) = reduction potential for nickel
E(Co) = reduction potential for cobalt
*Ethylene diamide
**Ethylene diamine tetra-acetate Both nickel and cobalt, if plated from a non-complexing system, are deposited at more anodic potentials than palladium, resulting in a deposit rich in the alloying metal and poor in palladium. To deposit the palladium/nickel or palladium/cobalt alloys, one needs to bring the reduction (plating) potential of the alloying base metal closer to that of palladium. The most common way of doing this is by binding the base alloying metal which is deposited at the more anodic potential into complexes and thus, moving the reduction potential of that metal in a negative, less anodic direction.

In the case of palladium/nickel alloy plating, ammonia is most commonly the ligand for both the palladium and the nickel and provides a stable alloy composition if plated in a wide range of current densities. The percent of metals in the alloy may be determined by the ratio of limiting current for both metals and ultimately by the concentration of metals in solution. Addition of a second oxygen containing ligand such as acetate, citrate, etc. does not affect the plating parameters and alloy deposition, as can be seen in Table 1 above.

Unlike, nickel, cobalt does not form strong complexes with ammonia and in a palladium/cobalt/ammonia system, cobalt is plated preferably producing a cobalt-rich alloy and a large variation in the alloy composition over the current density range. As can be seen from Table 1, addition of oxygen-containing ligands such as carboxylic acids (malonic, glutaric, etc.), which form strong complexes with cobalt, allows one to bring the cobalt electroplating reduction potential and the electroplating reduction potential for palladium closer to one another than they were when no second ligand was added and provide a superior system for palladium/cobalt alloy deposition. Thus, unlike palladium/nickel plating solutions where ammonia is the ligand for both metals and addition of other complexing systems is used merely to improve the conductivity of the solution, in the case of a palladium/cobalt alloy, the mixed ligand system is a superior solution for a plating bath.

In summary, Table 1 shows that, in an ammonia/ammonium system, the electroplating reduction potentials of palladium and nickel in a Pd/Ni plating bath do not change when a second ligand is added to the bath while the potentials of palladium and cobalt in a Pd/Co electroplating bath do get closer together when certain ligands are added to the bath. The cobalt electroplating potentials move in a negative less anodic direction. Oxygen-containing ligands are generally suitable. Specific examples of suitable ligands include, but are not limited to, carboxylic acids and their derivatives such as acetate, citrate, malonic acid, glutaric acid, citric acid, tartaric acid, oxalic acid, glycine and ethylene diamine tetra-acetate. Further it will be understood by the artisan that the addition of at least one second ligand is contemplated by the disclosure herein. The chemical reactions describing the formation of palladium and base metal complexes are shown below:

$$\text{PdA}+\text{NH3 (excess)}=[\text{Pd(NH3)4}]\text{A}+\text{NH3 (excess)} \quad (1)$$

In equation (1), $NH_3$ can be replaced by organic amines.

$$\text{MA}+\text{L}^{n-}\text{(excess)}=[\text{ML}x]^{2-xn}+\text{L}^{n-}\text{(excess)}+\text{A}^{2-} \quad (2)$$

In equations (1) and (2) the anion A may be a sulfate, halide (Fl, Cl, Br, I), nitrate, nitrite, acetate, phosphate or sulfamate.

In equation (2), M is an alloying base metal, and more particularly, one selected from the group consisting of iron, cobalt, ruthenium, rhodium and iridium;

ammonia is the ligand for palladium; and,

L is the ligand for the alloying base metal which ligand may be selected from the group consisting of mono-, di-, and tetra-carboxylic acids commonly known as acetic, malonic, glutaric, or ethylenediamine-tetraacetic acids. The concentration of the ligand in the bath depends upon the concentration of the alloying base metal salt in the bath. It is advantageous if the concentration of the ligand is at least the same or greater than the concentration of the base metal salt in the bath. The alloying base metal concentration depends upon the alloy composition to be deposited (10% to 95% Pd by weight). In one embodiment of the present invention, the concentration of the alloying base metal salt is about 0.01 to about 1 moles per liter and the concentration of the second ligand is about 0.04 to about 2 moles per liter and the concentration of the second ligand is in excess of the concentration of the alloying base metal salt.

The bath may be prepared by mixing a selected alloying base metal salt with a solution of the ligand from equation (2) in a stoichiometric ratio, followed by the addition of palladium-amino complex. The molar concentration of the palladium salt in the bath ranges from 0.01 to greater than 0.5 moles per liter where the upper range is based on solubility limitations.

To enhance the buffering capacity of the bath and its conductivity, appropriate and well known reagents such as ammonium salts can be added. Ammonium salts (typically sulfate, fluoride, chloride, bromide, iodide, nitrate, nitrite, acetate, phosphate and sulfamate)at a concentration ranging from 0.01 M to 2.0 M are used for this purpose.

The pH of the bath is adjusted to range from 3 to 10 by adding ammonium hydroxide or a strong acid such as $H_2SO_4$. The temperature of the bath and typical current densities are given in the following examples. The anode material may be platinum or platinized titanium.

The plating process in which the inventive bath or solution is used involves the following steps:

(a) applying through the electroplating bath a current density greater than 10 mA/cm$^2$ dependent on the type of process (e.g. rack or continuous) via a cathode disposed in the plating bath, and (b) maintaining in said bath an object whose exposed surface portions are to be plated with a palladium alloy for a time sufficient to develop upon the exposed surface portions a palladium alloy layer of desired thickness.

EXAMPLES

The present invention is further characterized by reference to the following specific examples of some preferred embodiments. Other embodiments, obvious to those skilled in the art, are within the scope and spirit of the invention taken from the present examples and the accompanying specification. The alloy fractions are given in weight percent, the concentrations are molar and the abbreviated terms for chemical symbols are consistent with the discussion and definitions above for equations (1) and (2).

Example 1

An electroplating bath for a 70Pd/30Co alloy for high speed plating which is typical of reel-to-reel type continuous feeding for electronic components such as connector contacts which are typically nickel plated beryllium copper. This bath produces bright, hydrogen-free ductile deposits with a Knoop hardness of 550 to 650 KHN, 50 g. load.

Approximately 72 Amp-sec. was applied to the bath to obtain 1 $\mu$m thick deposits.

$Pd(NH3)4]Cl_2$; where [Pd]=0.38 M
$CoCl_2$; [Co]=0.17 M
(NH4)Cl 0.38 M
malonic acid$^-$ 0.6 M
pH 7 to 9
Temperature 35 to 65 deg. C
Current density 50 to 700 mA/cm$^2$ Example 2

An electroplating bath for a 70Pd/30Co alloy for low speed plating which is typical for rack mounted articles.
$[Pd(NH3)4]SO_4$; where [Pd]=0.19 M
$CoSO_4$; [Co]=0.08 M
$(NH4)SO_4$; 0.38 M
glutaric acid 0.3 M
pH 8to 9
Temperature 30 to 45 deg. C
Current density 10 to 100 mA/cm$^2$ Example 3

An electroplating bath for a 50Pd/50Co alloy for high speed plating.
$[Pd(NH3)4]SO_4$; where [Pd]=0.38 M
$Co(CH_3COO)_2$; [Co]=0.35 M
$CH_3COO(NH4)$; 0.2 M
malonic acid 0.2 M
pH 7to 9
Temperature 45 to 65 deg. C
Current density 50 to 500 mA/cm$^2$ Example 4

An electroplating bath for a 90Pd/10Co alloy for high speed plating.
$[Pd(NH3)4](NO_3)_2$ where [Pd]=0.38 M
$CoSO_4$; [Co]=0.06 M
(NH4)Cl; 0.38 M
EDTA; 0.25 M
pH 7to 9
Temperature 45 to 65 deg. C
Current density 300 to 700 mA/cm$^2$ Changes and modifications in the specifically described embodiments can be carried out. For example, based upon the teaching herein, it would be appreciated that in the various Examples 1–4, other alloying metals could also be used to plate Pd alloys including but not limited to Fe, Ir, Rh and Ru. The plating solution taught herein could also be used in plating applications and processes having low current efficiencies (such as strike baths), low metal concentrations as well as low pH values.

It is understood that the addition of more than one separate ligand besides the first ligand could be added without exceeding the scope invention. The invention may be otherwise practiced by one skilled in the art, in addition to the specific embodiments included herein.

What is claimed is:

1. An aqueous palladium alloy electroplating bath consisting of:

a metal consisting essentially of a palladium salt having a palladium electroplating reduction potential and an alloying metal salt selected from the group consisting of cobalt salts and iron salts having an alloying metal electroplating reduction potential, and a mixed ligand system, said mixed ligand system comprising a first ligand selected from the group consisting of ammonia, amines, diamines, polyamines and their derivatives, said first ligand present in amount effective to form a complex with said palladium salt and a second ligand selected from the group consisting of an acetate, a citrate, malonic acid, glutaric acid, citric acid, tartaric acid, oxalic acid, ethylenediamine, glycine and ethylenediaminetetraacetate, said second ligand present in an amount effective to form a complex with said alloying metal salt to bring said alloying metal electroplating reduction potential in a negative, less anodic, direction relative to said alloying metal electroplating reduction potential in the presence of said first ligand alone.

2. The electroplating bath of claim 1, wherein the concentration of said alloying metal salt is from 0.01 to 1.0 moles per liter.

3. The electroplating bath of claim 1, wherein the concentration of said second ligand is from 0.04 to 2.0 moles per liter.

4. The electroplating bath of claim 1, wherein the pH thereof is from 3.0 to 10.0.

5. The electroplating bath of claim 1, wherein the temperature thereof is maintained between about 25 and 65 degrees Celsius.

6. The electroplating bath of claim 1, wherein a cathode is disposed therein and a current density greater than 10 mA/cm$^2$ is maintained at said cathode.

7. The electroplating bath of claim 1 wherein said palladium salt creates a palladium concentration therein greater than 0.01 moles per liter.

8. The electroplating bath of claim 1 wherein said first ligand is ammonia present in an ammonia/ammonium salt mixture wherein the concentration of said ammonium salt in said electroplating bath is from 0.01 to 2.0 moles per liter.

* * * * *